United States Patent [19]

Seragnoli

[11] 4,095,396

[45] Jun. 20, 1978

[54] DEVICE FOR GUIDING AND HOLDING CIGARETTE BATCHES IN AN APPARATUS FOR TRANSFERRING SAID BATCHES FROM A CONVEYOR TO A PACKING MACHINE

[75] Inventor: Enzo Seragnoli, Bologna, Italy

[73] Assignee: G. D. Societa per Azioni, Bologna, Italy

[21] Appl. No.: 780,102

[22] Filed: Mar. 22, 1977

[51] Int. Cl.[2] ..... B65B 11/28

[52] U.S. Cl. ..... 53/234; 53/148

[58] Field of Search ..... 53/234, 148, 150; 198/419, 486

[56] References Cited

U.S. PATENT DOCUMENTS

| | | | |
|---|---|---|---|
| 3,948,115 | 4/1976 | Seragnoli | 53/234 X |
| 3,956,865 | 5/1976 | Schmermund | 53/234 X |

*Primary Examiner*—Travis S. McGehee
*Attorney, Agent, or Firm*—Karl F. Ross

[57] ABSTRACT

A device for guiding and holding cigarette batches in two seven-cigarette layers and an upper six-cigarette layer. The device has two opposite movable walls each having an upper end projecting toward the batch and at the level of the six-cigarette layer.

4 Claims, 7 Drawing Figures

Fig. 1
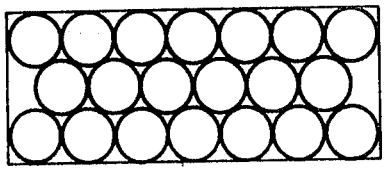
Fig. 2
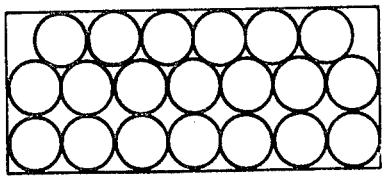
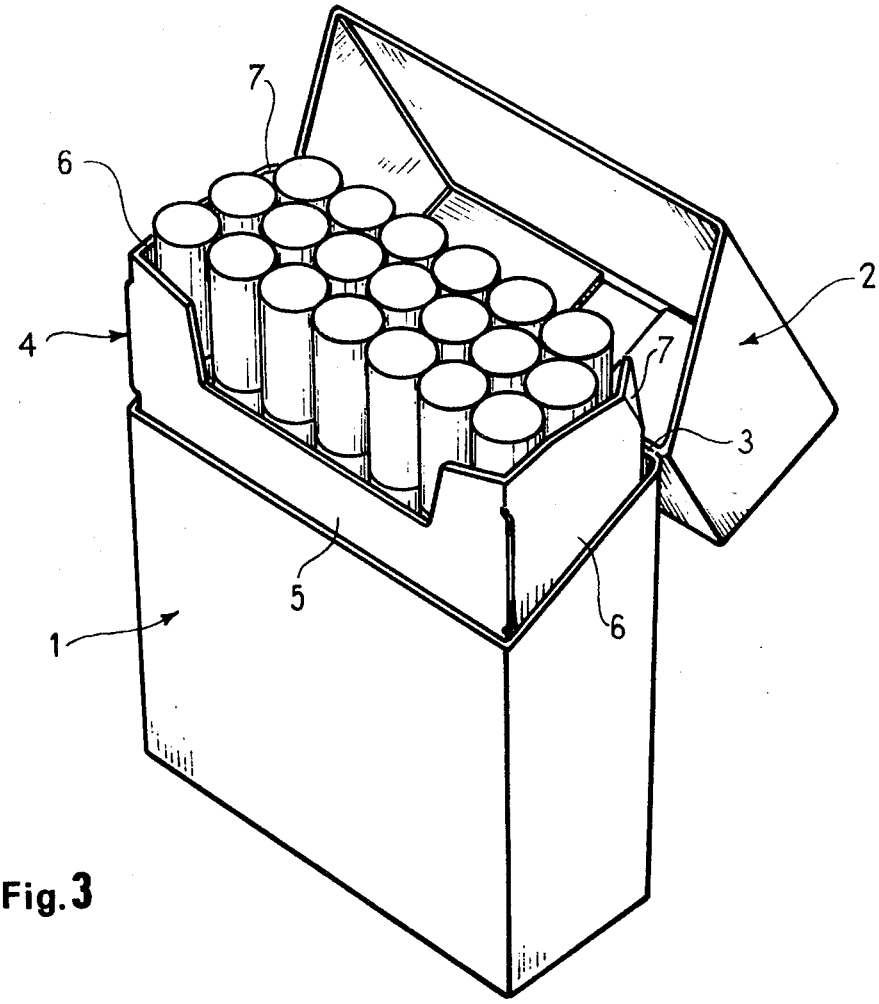
Fig. 3

DEVICE FOR GUIDING AND HOLDING CIGARETTE BATCHES IN AN APPARATUS FOR TRANSFERRING SAID BATCHES FROM A CONVEYOR TO A PACKING MACHINE

BACKGROUND OF THE INVENTION

The present invention relates to a device for guiding and holding cigarette batches in an apparatus for transferring said batches from a conveyor up to a machine for packing cigarettes into hinged-lid type packs.

DESCRIPTION OF THE PRIOR ART

According to what is known, the normal 20-cigarette batches fed to machines for packaging them into soft-type, or American, packs are made up of two seven-cigarette layers between which a six-cigarette layer is interposed.

As shown in FIG. 1, such batches have a substantially rectangular shape, symmetrical relative to the intermediate layer, and are provided — as it will be better described thereinafter — with a structure which, during the various transferring phases, proved to be sufficiently stable.

The machines for packing cigarettes into hinged-lid type packs can be fed, as known, with batches structured as shown in FIG. 1, as well as with batches structured as shown in FIG. 2.

The structure of the batch shown in FIG. 2 is substantially obtained from the structure shown in FIG. 1, simply by inverting the intermediate six-cigarette layer with one of the two seven-cigarette layer. This structure is clearly less stable than the structure of FIG. 1, but it has a particular conformation suitable to the hinged-lid pack in which it is housed.

As shown in FIG. 3, the hinged-lid packet comprises a body 1, and a lid 2 connected to the body 1 by means of a hinge 3. An inner element, or 'neck', 4 is made up of a central panel 5, and by two side panels 6. The inner element 4 is secured to the inside of body 1 in such manner as to adhere with its central panel 5 and the two side panels 6 respectively to the front and to the side faces of the same body 1. The inner element protrudes from the upper opening of the body to form — with lid 2 closed — a continuous element between the body 1 and the lid 2.

From FIG. 3 it clearly appears that the two corners 7 of the inner element 4 have been slightly bent, near the hinge 3, inwardly relative to the body 1. This configuration facilitates the closing of the lid 2.

Thus it readily can be seen why the cigarette stack arrangement shown in FIG. 2 is preferred: as shown in FIG. 3 the six-cigarette layer lies against the rear panel of the body 1.

Should the batch shown in FIG. 1 be housed into the hinged-lid packet shown in FIG. 3, the pressing action of the extremities of a seven-cigarette layer onto the bent corners 7 of the inner element 4 would cause the outward displacement of these corners 7, thus undoing the advantages deriving from the inwardly bent construction.

Batches or stacks of the type shown in FIG. 1, when completed (for example according to the U.S. Pat. Nos. 3,435,940 and 3,520,394), are sequentially fed — in a flap disposition — by a compartmented conveyor stepwise advancing in a direction transverse to the cigarette axes to a transfer station, wherein a pusher operates. The pusher is provided with a horizontal and reciprocating motion in the direction of the cigarette axes, and with an oscillating motion in the plane normal to the direction of said reciprocating motion.

During each dwell of the compartmented conveyor, a cigarette batch is ejected from the relative compartment by a pusher and transferred into a pocket of a multi-pocketed head, counterclockwise and stepwise rotated about a horizontal axis.

When in the pocket, the batch lies with its lower longitudinal extremities on a first pair of horizontal blades secured to the rotating head. The introduction of the batch into the pocket is guided by a stationary plate positioned between the horizontal blades and coplanar with the latter. A second pair of horizontal blades, parallel to the first pair, holds the batch by acting on the upper longitudinal extremities thereof.

During the introduction of the batch into a pocket, the external side of the same batch is guided, and then held, by a flat and vertical plate. This plate, as described in the U.S. Pat. Nos. 3,926,300 and 3,520,394, is secured to means which alternately move it toward, and away from said external side. The longitudinal extremities of the internal side of the batch are held by two vertical plates secured to the rotating head, and between these vertical plates there is provided a joining plate secured to the bed of the machine, the joining plate acting also as guiding element during the introduction of the batch into the pocket.

The rotating head — for example of the two oppositely disposed pocket type described in the U.S. Pat. No. 3,926,300 — is provided with two pliers pivoted on axes parallel to the rotating axis of the head.

The jaws of said pliers extend above and below the two pockets and bifurcate into two arms, the extremity of each of which is provided with a plate perpendicularly disposed relative to the development direction of the same arm.

During the introduction of the batch into a pocket, the jaws of this pocket are open, and they close at the completion of the introduction of the batch into the pocket. Thus, the plates engage the external side of the batch, and on the two sides of the vertical movable plate. More exactly, the two plates secured to the arms of the upper jaw will contact the upper cigarette layer of the batch, and the two plates secured to the arms of the lower jaw will contact the lower cigarette layer of the same batch.

The vertical movable plate is, therefore, free to retract, and the rotating head is rotated through 180°, thus transferring the pocket to a station wherein a horizontally reciprocating pusher operates. During the same 180° rotation, the other empty pocket will be transferred up to the position previously occupied by the first mentioned pocket.

The reciprocating pusher, in cooperation with a counter-pusher acting on the external side of the batch, and after the opening of the jaws, will transfer the batch together with a length of wrapping tin foil to the wrapping means of the packeting machine.

From the above it can be noted that the cigarette batches of the type shown in FIG. 1 are guided and held — during the introduction phase into the pocket of the rotating head, and during the subsequent transferring to the wrapping means — by stationary and movable means substantially formed in their entirety by four walls or plates, respectively contacting the two seven-cigarette layers, and the sides of the batch.

Such stationary and movable means have proved, in practice, to be perfectly suitable to their task, and sufficient for avoid any displacement, or sliding, or rolling of the cigarettes within the batch.

It should be noted that the intermediate six-cigarette layer, also if not contacting the stationary and movable means, is perfectly held — during the transferring phases — by the two seven-cigarette layers.

FIG. 4 is a diagram of a machine for packeting cigarettes into hinged-lid type packets. As above stated, said machine can be fed with cigarette batches having the structure shown in FIG. 1, as well as the structure shown in FIG. 2.

In said diagrams, the reference numeral 8 indicates a hopper for feeding and forming batches of cigarettes, the reference numeral 9 indicates a compartmented conveyor means moved stepwise for transferring batches of cigarettes to a station 10 formed by a head rotating about a horizontal axis.

From station 10 the cigarette batches are fed to a station 11, formed by a head rotating about a horizontal axis, wherein said batches are wrapped by a length of tin foil. From station 11 the batches are fed to another station 12, formed by a head rotating about a vertical axis, wherein the batches are provided, if required, with revenue labels, or advertising pictures.

Station 12 is followed by a station 13, formed by a head rotating about a vertical axis, wherein an inner element 4 is applied to the batches already wound in the foil (for example as described in U.S. Pat. No. 3,967,543 and copending application Ser. No. 522299 filed Nov. 8, 1974).

In addition, the machine comprises a station 15, formed by a head rotating about a horizontal axis, wherein the blanks 14 are formed in hinged-lid type packet.

It should be noted, in particular, that the rotating heads forming the stations 10 and 11 rotate about their axes, the first in a counterclockwise direction and the second in a clockwise direction, and that each has an exit (transfer) position diametrically opposite relative to the inlet position.

The machine diagrammatically shown in FIG. 4, in that section comprising the elements 8,9,10,11-i.e. those means for forming the cigarette batches and up to the station for wrapping with tin foil the batches - has substantially the same structure of the machine for packeting cigarettes into soft type, or American, packets described, for example, in the U.S. Pat. Nos. 3,628,309, 3,948,115.

It has to be noted that the machine shown in FIG. 4 will be provided with a station 10 having a jaw provided rotating head of the type above described with reference to the soft type pack packaging machine, should said machine be fed with cigarette batches of the type shown in FIG. 1.

Should the machine diagrammatically shown in FIG. 4 be fed with batches of the type shown in FIG. 2, the batches are conventionally made as described in the U.S. Pat. Nos. 3,435,940 and 3,520,394. According to what is known, and without any problem, also the transferring of said batches from the formation are is made through the compartmented conveyor 9, up to a pusher member having the task of transferring the individual batches into the station 10.

The guiding and holding means used in the station 10 for the batches shown in FIG. 1 (above described, and substantially comprising four flat movable and stationary elements, two of which adhering to the upper and lower cigarette layers, and two to the sides of the batch) have proved themselves inadequate and insufficient for avoiding shifting, or sliding, or rolling of the cigarettes forming the batch of the type shown in FIG. 2. This is true either during the transferring phase into one of the compartments of said head, as well as during the next transfer into station 11.

The main reason for the instability of the batches shown in FIG. 2, during the various transferring phases of said batches, is the lack of guiding and holding elements contacting the extremely disposed cigarettes of the six-cigarette layer.

The movable and stationary side walls, inside the compartments, should be integrated — for this reason — with filling elements laying on the same level of said six-cigarette layer.

In other words, in order to impart to the individual batches a good and constant control during the transferring phases for avoiding any possibility of relative shifting of the cigarettes, it has proved to be necessary to provide the compartments of the rotating head with a construction with respect to the six-cigarette layer.

It has now to be noted that, in the machine diagrammatically shown in FIG. 4, for having a correct position in packs of the type shown in FIG. 3 of cigarette batches of the type shown in FIG. 2 it is a necessary condition that said batches be fed to the rotating head of station 13 with the six-cigarette layer upwardly positioned.

If consideration is made of the fact that each cigarette batch — during its transfer through the rotating heads forming the stations 10, 11 and 12 — is rotated through 360° about its longitudinal axis (i.e. 180° in station 10, and 180° in station 11 — see FIG. 4), to satisfy the above condition each batch must be fed to the first station 10 with its six-cigarette layer upwardly directed.

Such a disposition of the batch, together with the fact that the head forming the station 10 is counterclockwise rotated, does not solve the problem of the instability of the batch in the easier way, i.e. by positioning — for obtaining said narrowing — filling elements in contact with the extremely positioned cigarettes of the upper layer. Such elements would oppose themselves to the rotation of the head.

SUMMARY OF THE INVENTION

The object of the present invention is, therefore, to provide a rotating head of the type described with reference to a soft-type pack packaging machine, and also used in hinged-lid type pack packaging machine fed with cigarette batches of the type shown in FIG. 1, and which has guiding and holding means adapt to allow the packaging of the particularly instable cigarette batches shown in FIG. 2.

More in general, and in conformity with the above object, a further object of the invention is to overcome the various problems arising from the packaging by a machine of the type diagrammatically shown in FIG. 4, of cigarette batches of the type shown in FIG. 2.

These and other objects are all attained with the device, according to the invention, for guiding and holding cigarette batches in an apparatus for transferring said batches from a conveyor up to a machine for packaging cigarettes into hinged-lid type packs, said packaging machine having a rotating head of the type comprising a plurality of equispaced radially disposed compartments, each compartment being formed by two pairs of stationary plates, the plates of each pair being spaced apart in the direction of the rotating axis of the head of a distance substantially equal to the length of the cigarettes, and the same plates of each pair being spaced apart of a distance equal to the thickness of said cigarette batch, and by two pairs of plier shaped movable elements in which the elements of each pair are coplanar and oppositely positioned relative to the stationary plates of the corresponding pair; a first, a second, and a third wall lying — during a dwell of said rotating head — between the pair of stationary plates of one of said radial compartments forming the guiding and holding surfaces for the cigarette batches, the first wall being tangential and radially movable relative to the compartment, the second wall being radially positioned inside the compartment and facing said first movable plate, and the third wall being coplanar with one of the stationary plates of the corresponding pair, said device being characterised in that said second wall comprises a stationary part and a movable part, said movable part being secured to one end of a lever oscillatable about a shaft parallel to the rotating axis of said head, and passing through an intermediate point of said oscillatable lever; a linking element being pivoted with one end to a projection of the first movable wall, and with the other end to the other end of said lever, for imparting an approaching and removal motion to said movable part and to the upper end of the first movable wall, the upper ends of said first movable wall and of said movable part projecting inwardly of said compartment.

BRIEF DESCRIPTION OF THE DRAWING

Further features and advantages will be more apparent from the following description of a preferred, but not exclusive, embodiment of the device according to the invention, as shown by way of example in the accompanying drawing, in which:

FIGS. 1 and 2 show, in the direction of the cigarette axes, two differently structured cigarette batches;

FIG. 3 is a perspective view of a hinged-lid type cigarette pack, containing a batch of cigarettes of the type shown in FIG. 2;

SPECIFIC DESCRIPTION

Figure 4:
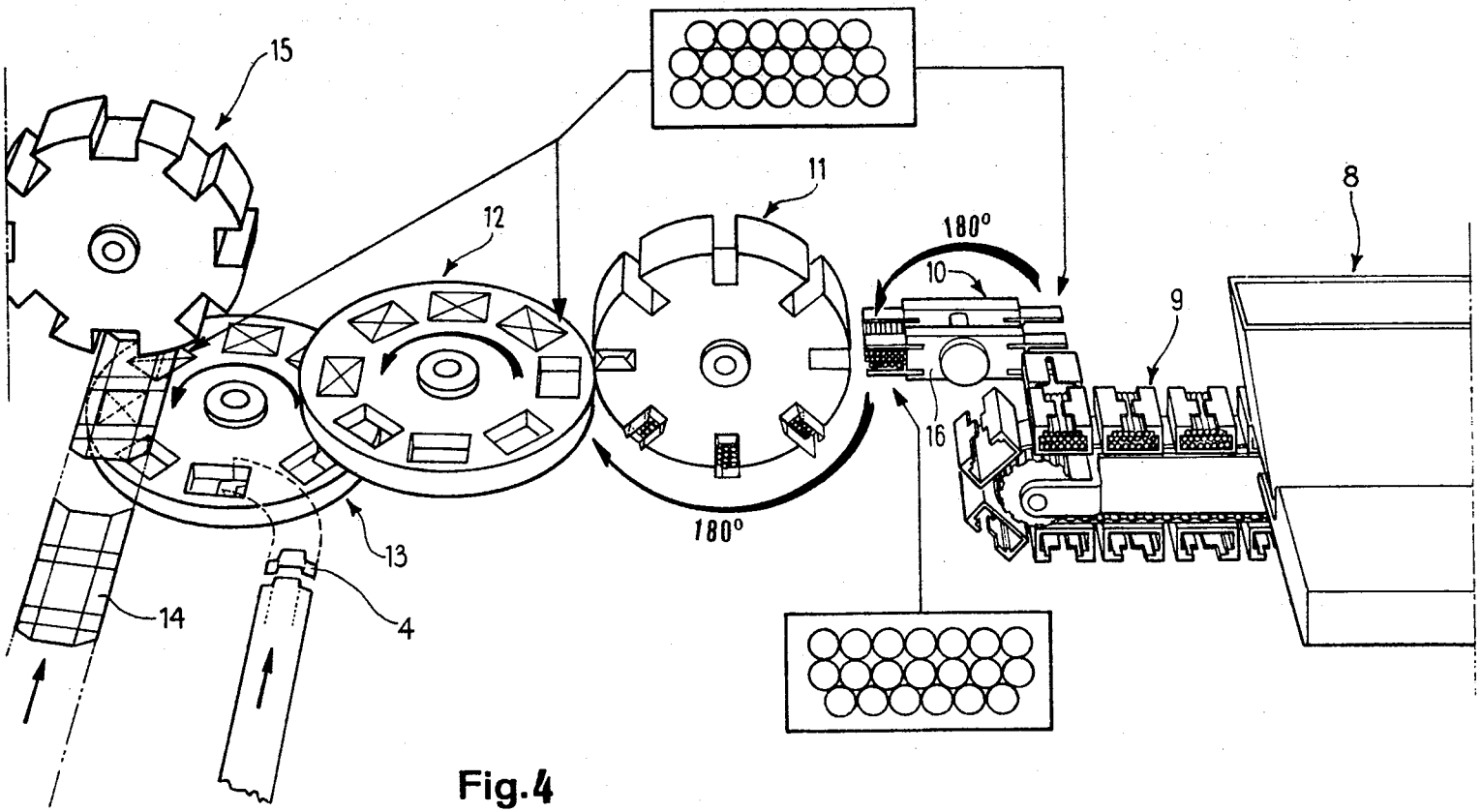
FIG. 4 is a perspective, and diagrammatic view of the various subsequent members forming the wrapping line of a hinged-lid-type pack packaging machine.
Figure 5:
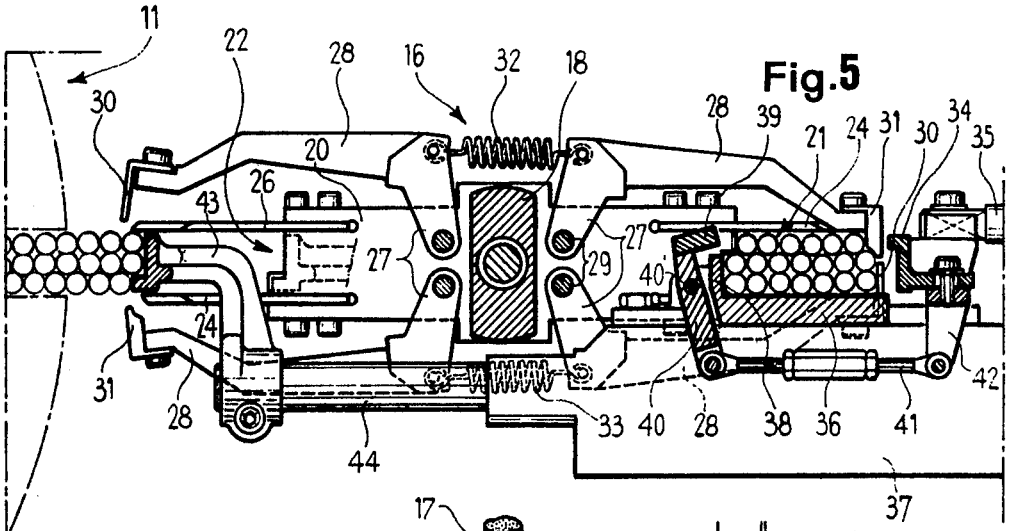
FIG. 5 is a front view of one of the members of FIG. 4 comprising the device according to the present invention, taken in partial section along the line V—V of FIG. 6.
Figure 6:
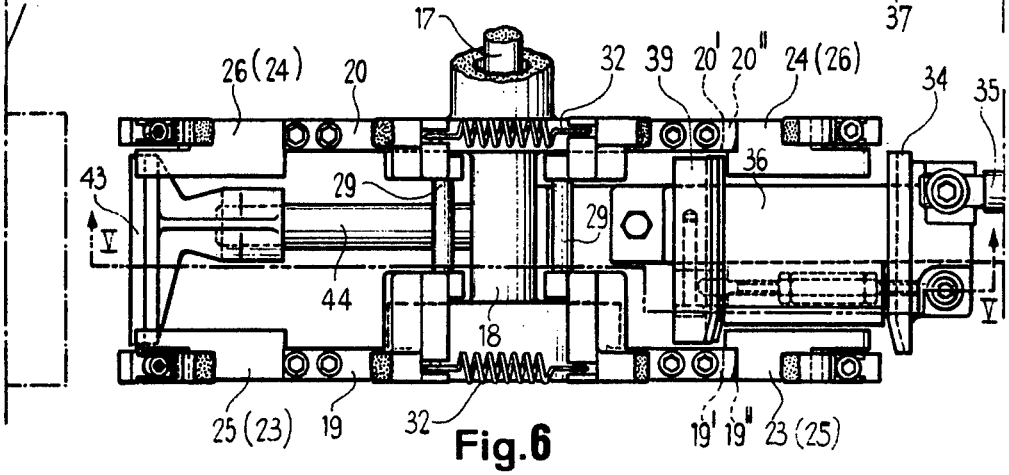
FIG. 6 is a top view of the same member of FIG. 5, with some parts removed for a better showing of other parts.

With particular reference to FIGS. 4, 5 and 6, the above mentioned station 10 is formed by a rotating head, generically indicated with 16.

The rotating head 16 is fed with cigarette batches of the type shown in FIG. 2, intermittently advanced by the compartmented conveyor 9. The head 16, in its turn, feeds the second rotating head forming the station 11, wherein the cigarette batches are wound in with the inner tin foil wrapper. The rotating head 16 is supported by a horizontal shaft 17, exiting from the bed (not shown) of the packeting machine, conventionally and intermittently moved in a counterclockwise direction: shaft 17 makes a 180° rotation at every operational step.

Secured to and coaxial with shaft 17 is a sleeve 18 on the extremities of which two vertical plates 19 and 20 are secured, said plates 19 and 20 being spaced apart by a distance substantially equal to the length of a cigarette.

The rotating head 16 is provided with two radial compartments, or pockets, 21 and 22 diametrically opposite one another, and having an antisymmetrical structure relative to the intermediate radial plane. Compartments 21 and 22 are so dimensioned to contain a cigarette batch of the type shown in FIG. 2, and with the axes of the cigarettes parallel to the shaft 17.

By considering, for example, the compartment 21 (the left one as seen in FIGS. 5 and 6) with head 16 stationary, and by indicating with the same reference numerals the corresponding antisymmetrical elements of the compartment 22, said compartment is upwardly delimited by a first pair of rectangular, horizontal and coplanar small plates 23 and 24, respectively secured to the plates 19 and 20, and downwardly delimited by a second pair of rectangular, horizontal and coplanar small blades 25 and 26 (shown only on the left compartment 22) respectively secured to the plates 19 and 20, and spaced apart from said first pair of a distance equal to the thickness of a cigarette batch of the type shown in FIG. 2.

Fixed to the rotating head 16, and associated to each compartment 21, 22 is a pliers 27 the jaws of which each comprise two separate arms 28 pivoted on shafts 29 parallel to shaft 17 and supported on the extremities by the two plates 19 and 20.

With reference, for example, to the right compartment 21, the jaws of the relating pliers 27 project their own arms 28 above and below said compartment, and in correspondence of its extremities.

The free ends of the two lower arms 28 are each provided with a small plate 30 which assumes a vertical disposition when the pliers 27 are closed. The free ends of the two upper arms 28 are also provided with a block member 31 chamfered on the side facing the compartment.

What has been stated for the right hand pair of pliers, is also valid for the pair of pliers associated to the left compartment 22, with the only difference that the plates 30 and the block members 31 assume, relative to the corresponding elements of the right pliers, an antisymmetric position with respect to the intermediate radial plane between the two compartments.

The upper and lower jaws of the two pliers are interconnected, respectively, by a first and a second pair of springs 32 and 33.

The two pliers are further provided with an opening and closing movement derived by conventional means, described in the above cited U.S. Pat. No. 3,926,300, and operating as therein explained.

The cigarette batches of the type shown in FIG. 2, flatwise positioned and resting on the external seven-cigarette layer, are individually engaged by a pushing means (not shown) reciprocatingly and transversally moved relative to the conveyor 9, and oscillating in a plane normal to the direction of said reciprocating motion, and transferred in the direction of the cigarette axes into the right compartment 21 of the rotating head 16, now in a dwelling condition.

At the beginning of the introduction, the seven-cigarette layer rests onto the blade 25, and the six-cigarette upper layer engages the blade 23. The left side of the batch engages the edge 19' of plate 19, which edge has a projection 19" at the same level of the six-cigarette layer, i.e. is shaped in such manner to be tangent to the three layers.

A movable wall 34 is further provided for acting as a guiding and holding element of the right side of the batch. Said wall has a profile specular to the edge 19' and projection 19", thus contacting the three layers, and is reciprocatingly moved in a direction normal to shaft 17.

The wall 34 is secured to a horizontal shaft 35, conventionally moved as described in the above cited U.S. Pat. No. 3,520,394.

During prosecution of the introduction of the batch into the compartment, the leading extremity of the batch slides, after having overcome the blade 25, onto a plate 36, secured to a support 37 fast to the bed of the machine, and acting as joining element between blades 25 and 26, and coplanar with the latter.

In this stage, as soon as the edge 19' has been overcome, the lower portion of the left side of the batch is guided by a vertical edge 38 of plate 36, said edge 38 being tangentially positioned relative to the two lower seven-cigarette layers, while the upper six-cigarette layer come close to a rod 39.

The rod 39 can be oscillated relative to said guiding position, and is secured to the upper end of a lever 40, pivoted in 40' onto the machine bed. The lower end of lever 40 is pivoted at one end of an adjustable rod 41, the other end of which is pivoted to a projection 42 of wall 34: the lever 40 is thus controlled by the reciprocating shaft 35.

It is clear from the above that the wall 34 and the rod 39 are simultaneously operated, and they come close to and move away from the sides of the cigarette batch, and substantially operate in a pliers fashion, controlled by the reciprocating motion of shaft 35.

Guided by these stationary and movable members, the cigarette batch is thus completely introduced into compartment 21.

In the final stage of the introduction, the leading end of the cigarette batch overlies the blade 26, while its left side comes to adhere to an edge 20' of the plate 20, also said edge 20' being provided with a projection 20" so that said edge comes to adhere to the three layers of the cigarette batch.

In order to facilitate the introduction of the batch into the compartment, and to avoid jaming of the cigarettes, the various guiding elements are provided with suitable chamfered portions on the sides along which the introduction is carried out.

As soon as the introduction of the batch into the compartment is completed, the pliers 27 closes, and the extremities of its lower arms pass through openings made in the blades 25 and 26, and approach the lower cigarette layer of the batch, thus carrying the plates 30 in contact with the two ends of the intermediate and lower seven-cigarette layers in correspondence with the right side of the batch. The two upper arms are simultaneously advanced, passing through openings made in the blades 23 and 24, to the upper six-cigarette layer, thus taking the block elements 31 in contact with the two ends of the upper six-cigarette layer in correspondence of the right side of the batch, and of the intermediate seven-cigarette layer.

Shaft 35 is now controlled to make its backward stroke, thus removing the wall 34 and the rod 39 from the sides of the cigarette batch.

Head 16 is counterclockwise rotated through 180°, thus transferring the compartment 21 to the discharging position, i.e. feeding position, of station 11, and the empty compartment 22 to the position previously occupied by the compartment 21, awaiting a new cigarette batch in the same manner as described with reference to compartment 21.

In the discharging position (left, as seen in FIGS. 5 and 6) there is provided a pusher member 43 secured to one end of a shaft 44. The shaft 44 is carried by the support 37, and is reciprocatingly moved, horizontally and radially relative to the rotating head 16.

The pushing surface of the pusher member 43 has the same profile of the plates 19 and 20, is moved in the area delimited by said two plates 19 and 20, and engages the right side (as seen in FIGS. 5 and 6) of the cigarette batch, thus transferring the latter, together with a length of wrapping material (tin foil), into the rotating head forming the station 11.

A new cigarette batch is introduced into the empty compartment 22, and the machine cycle repeated.

Figure 7:
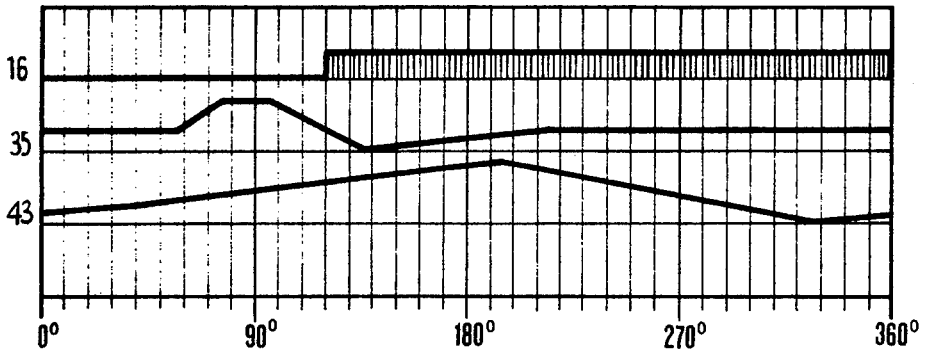
FIG. 7 shows the graphs, plotted relative to a common reference, of the motion laws of important parts of the members shown in FIGS. 5 and 6 during one machine cycle.

The graphs of FIG. 7 diagrammatically show, in function of the rotation degree of a common driving shaft (cyclic shaft), the motion laws of the rotating head 16, of the shaft 35 to which are connected the wall 34 and the rod 39, and of the pusher member 43.

In the graph relating the rotating head 16, the portion coinciding with the horizontal axis indicates the dwelling time of said head, and the dashed portion indicates the movement time. In the graphs relating the members 35 and 43, the horizontal portions indicate the dwelling times, the upwardly directed portions indicate the movement times of the forward stroke of said members 35 and 43, and the downwardly directed portions indicate the movement times of the backward stroke of the same members.

From the graphs it can be noted that the shaft 35, after introduction of a cigarette batch into the compartment, is briefly advanced (portion comprised between 55° and 75°), thus pressing the elements 34 and 39 against the two opposite sides of the cigarette batch. This is done to exert a stabilizing action on the cigarettes, and to avoid — during the closing phase of pliers 27 — any interference between cigarettes and plates 30 or block members 31.

As it appears from the above, the present device allows to wrap of cigarette batches of the type shown in FIG. 2 by a packaging machine of the type diagrammatically shown FIG. 4. More in particularly, the guiding element 39 and the associated element 34 avoid, during the transfer of the cigarette batch into the compartment, any shifting of the cigarettes relative to the batch.

I claim:

1. In a device for guiding and holding cigarette batches in an apparatus for transferring said batches from a conveyor to a machine for packaging cigarettes into hinged-lid-type packs said packaging machine having a rotating head comprising a plurality of equispaced radially disposed compartments, each compartment being formed by two pairs of stationary plates, the plates of each pair being spaced apart in the direction of the rotating axis of the head of a distance substantially equal to the length of the cigarettes, and the same plates of each pair being spaced apart of a distance equal to the thickness of said cigarette batch, and by two pairs of plier-shaped movable elements in which the elements of each pair of plier-shaped movable elements are coplanar and oppositely positioned relative to the stationary plates of the corresponding pair; and a first, a second, and a third wall lying - during a dwell of said rotating head - between the pair of stationary plates of one of said radial compartments forming the guiding and holding surfaces for the cigarette batches, the first wall being tangential and radially movable relative to the compartment, the second wall being radially positioned inside the compartment and facing said first movable plate, and the third wall being coplanar with one of the stationary plates of the corresponding pair, the improvement wherein said second wall comprises a stationary part and a movable part, said movable part being secured to one end of a lever oscillatable about a shaft parallel to the rotating axis of said head, and passing through an intermediate point of said oscillatable lever; a linking element is pivoted with one end to a projection of the first movable wall, and with the other end to the other end of said lever, for imparting an approaching and removal motion to said movable part and to the upper end of the first movable wall and of said movable part projecting inwardly of said compartment.

2. The improvement defined in claim 1 wherein the projecting portion of said first movable wall and of said movable part has a length substantially equal to half the diameter of a cigarette.

3. The improvement defined in claim 1 wherein the projecting portion of said first movable wall and of said movable part has a height substantially equal to the diameter of a cigarette.

4. The improvement defined claim 1 wherein said linking element has a turnbuckle structure.

* * * * *